US008054989B2

(12) United States Patent
Paik

(10) Patent No.: US 8,054,989 B2
(45) Date of Patent: Nov. 8, 2011

(54) ACOUSTIC CORRECTION APPARATUS AND METHOD FOR VEHICLE AUDIO SYSTEM

(75) Inventor: Soon Kwon Paik, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 560 days.

(21) Appl. No.: 12/329,211

(22) Filed: Dec. 5, 2008

(65) Prior Publication Data

US 2009/0154725 A1 Jun. 18, 2009

(30) Foreign Application Priority Data

Dec. 13, 2007 (KR) ..... 10-2007-0129842

(51) Int. Cl.
*H04H 1/00* (2006.01)

(52) U.S. Cl. ..... 381/86

(58) Field of Classification Search ..... 381/86, 381/56, 53, 103, 160, 120, 122; 600/459; 379/406.01–406.06
See application file for complete search history.

(56) References Cited

U.S. PATENT DOCUMENTS 6,386,039 B1 5/2002 Peters
2004/0258252 A1* 12/2004 Inoue et al. ..... 381/71.4
2008/0312538 A1* 12/2008 Shahar et al. ..... 600/459
2009/0106021 A1* 4/2009 Zurek et al. ..... 704/226

FOREIGN PATENT DOCUMENTS

KR 10-2006-0098726 9/2006
KR 10-2007-0007488 1/2007

* cited by examiner

*Primary Examiner* — Dao H Nguyen
*Assistant Examiner* — Tram H Nguyen
(74) *Attorney, Agent, or Firm* — Edwards Angell Palmer & Dodge LLP; Peter F. Corless

(57) ABSTRACT

Disclosed herein is an acoustic correction apparatus and method for vehicle audio systems which is capable of providing optimal sound at a reference level to a listener even though the acoustic spatial response characteristics in the room of a vehicle vary due to a change in the material of seat covers or the like. A first acoustic analysis unit obtains target frequency characteristic data at a specific listening location based on generated acoustic signals played from an audio system. A second acoustic analysis unit obtains measured frequency characteristic data at the listening location based on measured acoustic signals collected by the microphone unit. An acoustic correction unit adjusts the equalizer of the audio system based on the target and measured frequency data.

6 Claims, 4 Drawing Sheets

ACOUSTIC CORRECTION APPARATUS AND METHOD FOR VEHICLE AUDIO SYSTEM

CROSS-REFERENCE TO RELATED APPLICATIONS

This application claims under 35 U.S.C. §119(a) priority to Korean Application No. 10-2007-0129842, filed on Dec. 13, 2007, the disclosure of which is incorporated herein by reference in its entirety.

BACKGROUND

1. Technical Field

The present invention relates to an apparatus and method for correcting sound played through a vehicle audio system so that a listener can hear the sound in an optimal state.

2. Related Art

Some vehicles are equipped with an audio system that is in advance optimally tuned to the acoustic spatial response characteristics of the internal space of the vehicles.

Since the internal space is very small, the frequency characteristics of sound played through the audio system vary sensitively with changes in the interior of the vehicles, particularly changes in the material of the seat covers. In the case where the frequency characteristics vary as described above, it is necessary to correct sound by adjusting the equalizer of the audio system. Such correction is not easy to do for persons who are not listening experts. Furthermore, the frequency characteristics vary with the number or positions of passengers and the like.

The above information disclosed in this Background section is only for enhancement of understanding of the background of the invention and therefore it may contain information that does not form the prior art that is already known in this country to a person of ordinary skill in the art.

SUMMARY

Accordingly, the present invention has been made keeping in mind the above problems occurring in the prior art, and an object of the present invention is to provide an acoustic correction apparatus and method for a vehicle audio system which is capable of detecting the distortion of frequency characteristics attributable to the above-described factors and automatically correcting sound played through the audio system, thereby providing optimal sound at a reference level to a listener.

Another object of the present invention is to provide an acoustic correction apparatus and method for a vehicle audio system which enables a user to compensate for or remove the distortion of frequency characteristics using a frequently used music CD or the like without requiring a test signal used when an audio system is initially tuned.

In order to accomplish the above objects, in one aspect, the present invention provides an acoustic correction apparatus for a vehicle audio system, including a microphone unit installed in an internal space of a vehicle; a first acoustic analysis unit for obtaining target frequency characteristic data at a specific listening location based on generated acoustic signals played from an audio system; a second acoustic analysis unit for obtaining measured frequency characteristic data at the listening location based on measured acoustic signals collected by the microphone unit; and an acoustic correction unit for adjusting an equalizer of the audio system based on the target and measured frequency data.

The target frequency characteristic data is obtained using a first reference transfer function or functions between the speakers of the audio system and the listening location, which are previously measured. In contrast, the measured frequency characteristic data is obtained using a second reference transfer function between the microphone unit and the listening location, which is previously measured.

Preferably, the measured frequency characteristic data is obtained by calculating an average frequency response corresponding to each frequency band of the equalizer based on spectral data that is obtained by sampling the measured acoustic signals at a specific time interval or intervals.

In another aspect, the present invention provides an acoustic correction method for a vehicle audio system, including the steps of: playing a sound source through an audio system; obtaining target frequency characteristic data at a specific listening location from generated acoustic signals, which are played through an audio system, based on a first reference transfer function or functions between speakers of the audio system and the specific listening location, which are previously measured; obtaining measured frequency characteristic data at the listening location from measured acoustic signals, which are collected by a microphone unit, based on a second reference transfer function between the microphone unit and the listening location, which is previously measured; and adjusting an equalizer of the audio system based on the target and measured frequency characteristic data.

Preferably, the step of obtaining the measured frequency characteristic data includes the steps of: obtaining spectral data by sampling the measured acoustic signals at specific time intervals; and calculating an average frequency response for each frequency band of the equalizer based on the spectral data.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The above and other features of the invention are discussed infra.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

Acoustic correction apparatuses and methods for a vehicle audio system according to preferred embodiments of the present invention will be described in detail with reference to the accompanying drawings.

Figure 1:
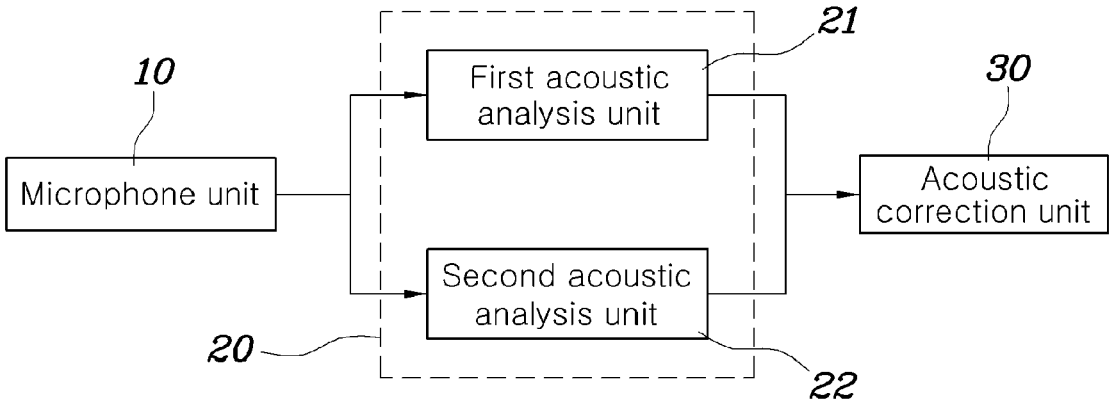
FIG. 1 is a diagram showing the construction of an acoustic correction apparatus according to an embodiment of the present invention.

As shown in FIG. 1, an acoustic correction apparatus according to an embodiment of the present invention includes a microphone unit 10, an acoustic analysis unit 20, and an acoustic correction unit 30.

The microphone unit 10 is used to monitor sound which is output from a vehicle audio system at a specific location in the internal space of a vehicle, and converts an input sound wave into an electrical signal. For example, a hands-free microphone typically mounted in a vehicle or a voice recognition microphone provided in a driver assistant device may be used as the microphone unit 10.

The acoustic analysis unit 20 includes a first acoustic analysis unit 21 for calculating target frequency characteristic data at a specific listening location, for example, the location of the driver, and a second acoustic analysis unit 22 for calculating measured frequency characteristic data at the listening location. The target frequency characteristic data corresponds to the optimal quality at which a listener desires to listen to a sound source through the audio system at a listening location, and the measured frequency characteristic data corresponds to the actual quality of sound that is currently being heard by the listener at the listening location.

The acoustic correction unit 30 obtains correction frequency characteristics by comparing the target frequency characteristic data with the measured frequency characteristic data, and automatically adjusts the equalizer of the audio system based on the correction frequency characteristics. Preferably, the correction frequency characteristics may be obtained through the spectral subtraction between the target frequency characteristic data and the measured frequency characteristic data.

Figure 3:
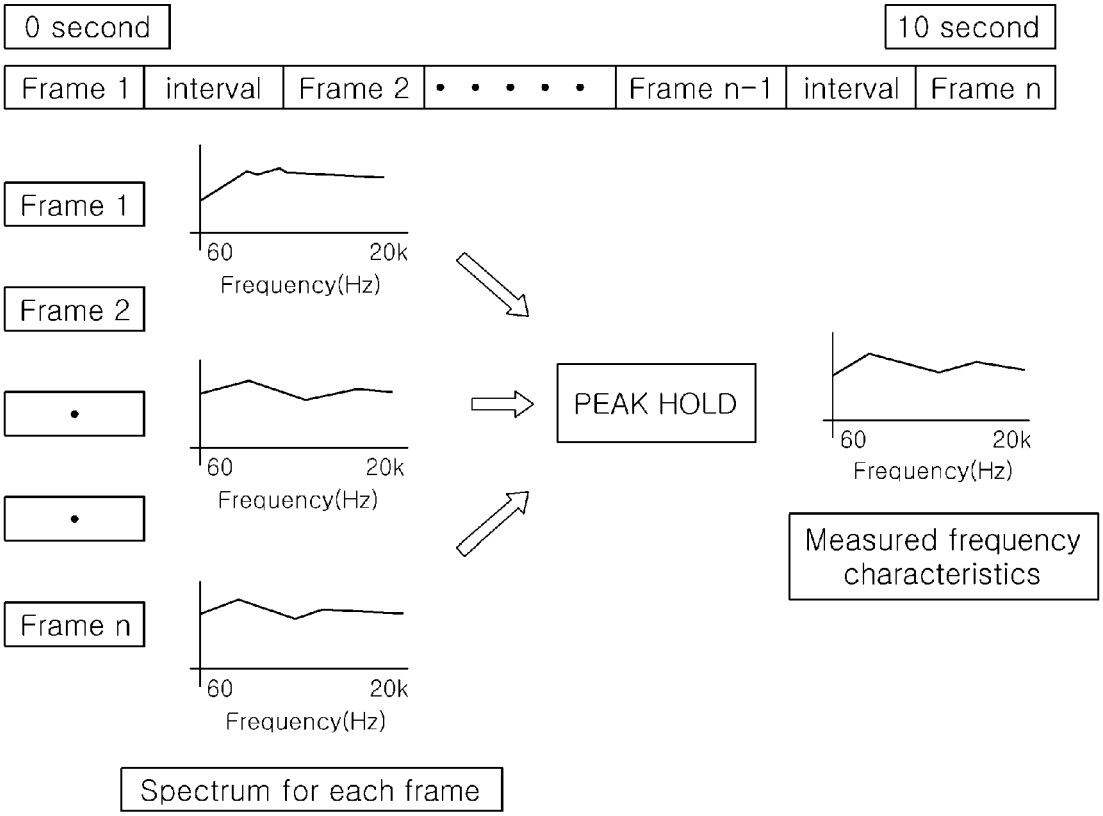
FIG. 3 is a diagram illustrating a process of obtaining measured frequency characteristic data through averaging according to an embodiment of the present invention.
Figure 4:
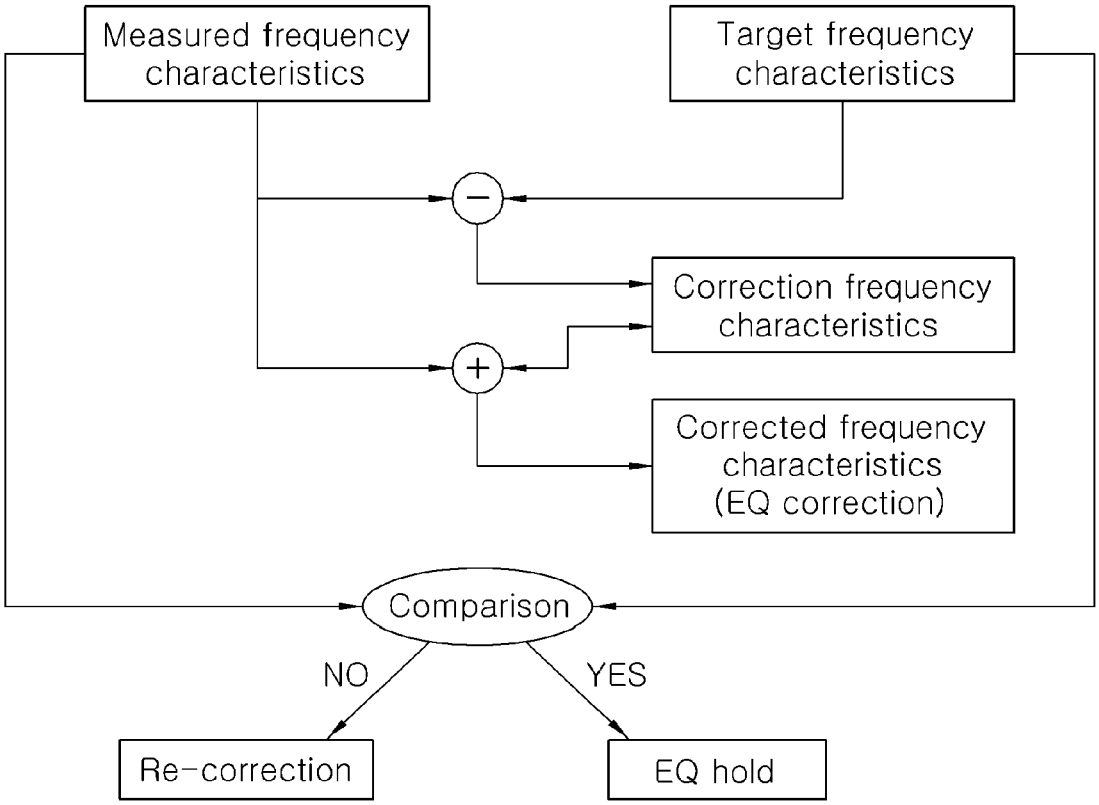
FIG. 4 is a diagram illustrating an acoustic correction method according to an embodiment of the present invention.

Acoustic correction methods using the above-described acoustic correction apparatus will be described in detail below with reference to FIGS. 2 to 4.

Figure 2:
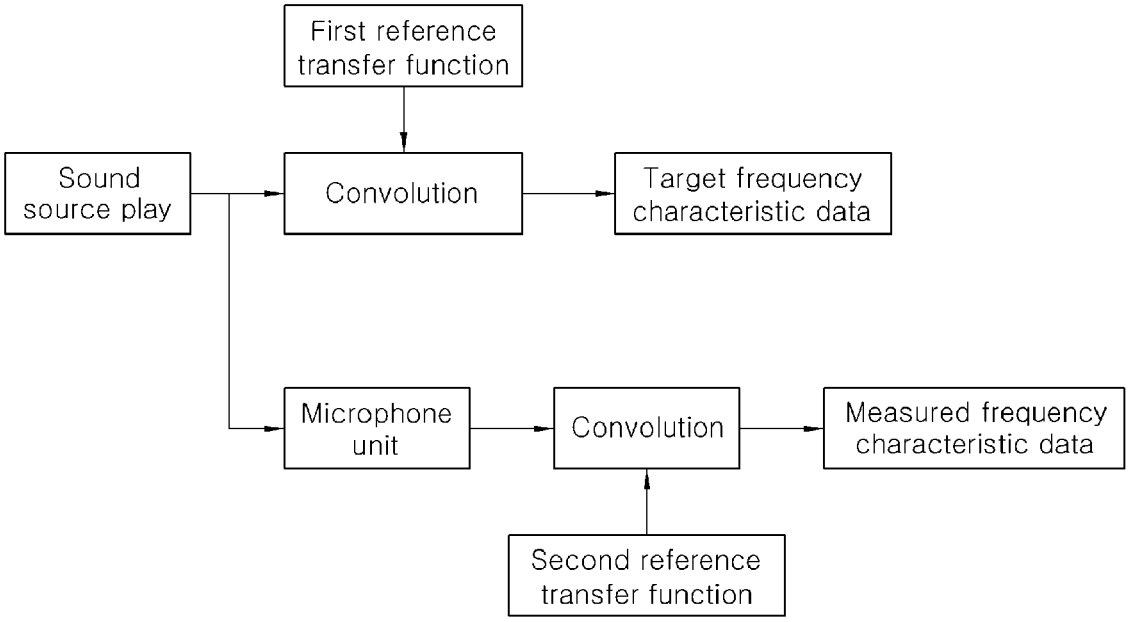
FIG. 2 is a diagram illustrating a process of obtaining target and measured frequency characteristic data according to an embodiment of the present invention.

As shown in FIG. 2, the target frequency characteristic data and measured frequency characteristic data are obtained by playing a sound source through an audio system. It is not necessary to use as this sound source the test signal that is used when the audio system is initially turned. For instance, a typical music CD that is frequently listened to by a listener may be used as the sound source.

The target frequency characteristic data is obtained by convoluting sound (hereinafter referred to as 'generated acoustic signals') played from an audio system using a first reference transfer function or functions. The first reference transfer function or functions can be obtained from the acoustic spatial response characteristics of a reference vehicle used for tuning the audio system, and correspond to acoustic transfer function or functions between the speakers of the audio system and the listening location. For example, in the case in which the audio system includes six speakers, that is, six channels, the target frequency characteristic data may be expressed as follows:

$X_{FL}(n)=S(n)*H_{FL}$: target frequency characteristics of the front left speaker $X_{FR}(n)=S(n)*H_{FR}$: target frequency characteristics of the front right speaker $X_{RL}(N)=S(n)*H_{RL}$: target frequency characteristics of the rear left speaker $X_{RR}(N)=S(n)*H_{RR}$: target frequency characteristics of the rear right speaker $X_{wfr}(n)=S(n)*H_{wfr}$: target frequency characteristics of the woofer $X_{CTR}(n)=S(n)*H_{CTR}$: target frequency characteristics of the center speaker Here, S(n) denotes a generated acoustic signal, and $H_{FL}$, $H_{FR}$, $H_{RI}$, $H_{RR}$, $H_{wfr}$, and $H_{CTR}$ denote first reference transfer functions corresponding to the front left speaker, the front right speaker, the rear left speaker, the rear right speaker, the woofer and the center speaker, respectively.

The measured frequency characteristic data is obtained by convoluting sound (hereinafter referred to as 'collected sound signals') collected by the microphone unit 10 using a second reference transfer function. The second reference transfer function can be obtained from the acoustic spatial response characteristics of a reference vehicle used for the tuning of the audio system, in the same manner as the first reference transfer function or functions, and corresponds to an acoustic transfer function between the microphone unit 10 and the listening location. The second reference transfer function is used to compensate for the difference in the response characteristics attributable to the difference between the microphone unit 10 and the listening location. For example, in the case in which the audio system includes six speakers, that is, six channels, the target frequency characteristic data may be expressed as follows:

$Y_{FL}(n)=s(n)*H_{FL}*Hm$: measured frequency characteristics of the front left speaker $Y_{FR}(n)=s(n)*H_{FR}*Hm$: measured frequency characteristics of the front right speaker $Y_{RL}(n)=s(n)*H_{RL}*Hm$: measured frequency characteristics of the rear left speaker $Y_{RR}(n)=s(n)*H_{RR}*Hm$: measured frequency characteristics of the rear right speaker $Y_{wfr}(n)=s(n)*H_{wfr}*Hm$: measured frequency characteristics of the woofer $Y_{CTR}(n)=s(n)*H_{CTR}*Hm$: measured frequency characteristics of the center speaker Here, s(n) denotes a measured acoustic signal, and Hm denotes a second reference transfer function.

A process of obtaining the measured frequency characteristic data will be described in detail with reference to FIG. 3.

The second acoustic analysis unit 22 obtains average frequency responses for respective frequency bands of the equalizer of the audio system based on spectral data obtained by sampling the measured acoustic signals, which are collected by the microphone unit 10, at a specific time interval or intervals over a specific period of time. In the case in which the number of sample frames obtained through sampling over 10 seconds is n as shown in FIG. 3, frequency responses corresponding to respective frequency bands of the equalizer can be obtained by analyzing the frequency spectra of the n sample frames. If frequency responses (for example, peak values may be taken) obtained for a first frequency band of the equalizer are two or more in number, the average value of the frequency responses is used as a frequency response of the first frequency band.

The first reason why the time interval or intervals are used in the sampling of the measured acoustic signals is to prevent real-time processing from being hindered due to the allocation of excessive resources to the analysis and processing of the measured acoustic signals because of an excessive number of sampling frames, and the second reason is to increase the probability of obtaining frequency characteristic data over several frequency bands, preferably the full band of the equalizer. The frequency components of the full band may not be included depending on the sound source played in an audio system. In this case, if a frequency response corresponding to a specific band is not obtained from measured acoustic signals, it is not necessary to perform acoustic correction on the corresponding band.

Meanwhile, although a noise from the inside or outside of the vehicle, such as from a horn, which is other than acoustic signals to be measured, may be input to the microphone 10, the possibility of erroneous sound correction occurring as a result of this temporary noise can be decreased significantly through an averaging process for the sampling time intervals and the frequency responses.

An acoustic correction method using the target and measured frequency data will be described with reference to FIG. 4.

The acoustic correction unit 30 obtains frequency characteristic data for correction from the target and measured frequency data that is obtained by the acoustic analysis unit 20. The frequency characteristic data for correction is obtained by obtaining frequency characteristics satisfying the equation $X_{xx}(n)-Y_{xx}(n)=0$ using the spectral subtraction method. Here, $X_{xx}(n)$ and $Y_{xx}(n)$ correspond to the target frequency characteristics and measured frequency characteristics of an xx channel, respectively. The acoustic correction unit 30 adjusts (acoustically corrects) the equalizer based on the correction frequency characteristics.

The acoustic correction unit 30 determines whether acoustic correction has been correctly performed by comparing target frequency characteristic data and measured frequency characteristic data, which are calculated after the equalizer has been adjusted. If, as a result of the determination, the acoustic correction is determined to have been correctly performed, the acoustic correction unit 30 maintains the adjusted equalizer as it is. If, as a result of the determination, the acoustic correction is determined not to have been correctly performed, the acoustic correction unit 30 adjusts the equalizer again. It should be noted that an adaptive filter does not need to be used for the acoustic correction unit 30. It can be considered that the acoustic spatial response characteristics in the room of a vehicle are stationary once the interior of the room is changed.

According to the present invention, even though acoustic spatial response characteristics in the room of a vehicle vary due to a change in, e.g., the material of seat covers or the like, a listener can be provided with optimal sound at a reference level.

Moreover, a user can compensate for or remove the distortion of frequency characteristics using a frequently used music CD or the like without requiring a test signal that was used when an audio system was first tuned. As a result, optimal sound can be provided to a listener at anytime.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An acoustic correction apparatus for a vehicle audio system, comprising:

a microphone unit installed in an internal space of a vehicle;

a first acoustic analysis unit for obtaining target frequency characteristic data at a specific listening location based on generated acoustic signals played from an audio system;

a second acoustic analysis unit for obtaining measured frequency characteristic data at the listening location based on measured acoustic signals collected by the microphone unit; and an acoustic correction unit for adjusting an equalizer of the audio system based on the target and measured frequency data.

2. The acoustic correction apparatus as set forth in claim 1, wherein the target frequency characteristic data is obtained using a first reference transfer function or functions between speakers of the audio system and the listening location.

3. The acoustic correction apparatus as set forth in claim 1, wherein the measured frequency characteristic data is obtained using a second reference transfer function between the microphone unit and the listening location.

4. The acoustic correction apparatus as set forth in claim 1, wherein the measured frequency characteristic data is obtained by calculating an average frequency response corresponding to each frequency band of the equalizer based on spectral data that is obtained by sampling the measured acoustic signals at a specific time interval or intervals.

5. An acoustic correction method for a vehicle audio system, comprising the steps of:

playing a sound source through an audio system;

obtaining target frequency characteristic data at a specific listening location from generated acoustic signals, which are played through the audio system, based on a first reference transfer function or functions between speakers of the audio system and the specific listening location;

obtaining measured frequency characteristic data at the listening location from measured acoustic signals, which are collected by a microphone unit, based on a second reference transfer function between the microphone unit and the listening location; and adjusting an equalizer of the audio system based on the target and measured frequency characteristic data.

6. The acoustic correction method as set forth in claim 5, wherein the step of obtaining the measured frequency characteristic data comprises the steps of:

obtaining spectral data by sampling the measured acoustic signals at a specific time interval or intervals; and calculating an average frequency response for each frequency band of the equalizer based on the spectral data.

* * * * *